United States Patent [19]

Kemeny et al.

[11] Patent Number: 4,938,113

[45] Date of Patent: Jul. 3, 1990

[54] ELECTROMAGNETIC PROJECTILE LAUNCHER WITH REDUCED MUZZLE ARCING AND ASSOCIATED METHOD

[75] Inventors: George A. Kemeny, Wilkins Twp., Allegheny County, Pa.; William C. Condit, Jr., Huletts Landing, N.Y.

[73] Assignee: Westinghouse Electric Corp., Pittsburgh, Pa.

[21] Appl. No.: 290,397

[22] Filed: Dec. 29, 1988

[51] Int. Cl.[5] ..... F41B 6/00

[52] U.S. Cl. ..... 89/8; 124/3; 200/144 AP

[58] Field of Search ..... 89/8; 124/3; 200/144 AP; 310/12; 318/135

[56] References Cited

U.S. PATENT DOCUMENTS

| | | | |
|---|---|---|---|
| H123 | 9/1986 | Wright | 89/8 |
| 4,319,168 | 3/1982 | Kemeny | 318/135 |
| 4,343,223 | 8/1982 | Hawke et al. | 89/8 |
| 4,423,662 | 1/1984 | McAllister | 89/8 |
| 4,437,383 | 3/1984 | Deis et al. | 89/8 |
| 4,562,320 | 12/1985 | van der Scheer | 200/144 AP |
| 4,572,964 | 2/1986 | Honig | 89/8 |
| 4,714,003 | 12/1987 | Kemeny | 89/8 |

FOREIGN PATENT DOCUMENTS

| | | | |
|---|---|---|---|
| 144411 | 6/1920 | United Kingdom | 124/3 |
| 828865 | 2/1960 | United Kingdom | 200/144 AP |

*Primary Examiner*—Stephen C. Bentley

*Attorney, Agent, or Firm*—D. Schron

[57] ABSTRACT

Electrical circuitry for preventing or substantially reducing electrical arcing at the muzzle of an electromagnetic projectile launcher. The circuitry provides a plurality of switches which interconnect portions of the rails of the launcher so that a unidirectional current flows through, the armature of the launcher is a first direction when the armature is in a first section of the launcher and a second section of the launcher. The switches, also cause a current, in a direction opposite the direction of the first direction, to flow through the armature of the launcher when the armature is in the second section of the launcher.

1 Claim, 1 Drawing Sheet

ELECTROMAGNETIC PROJECTILE LAUNCHER WITH REDUCED MUZZLE ARCING AND ASSOCIATED METHOD

BACKGROUND OF THE INVENTION

1. Field of the Invention

This invention relates to electromagnetic projectile launchers and, more specifically, to electromagnetic projectile launchers which include circuitry for reducing or eliminating the electrical arc which is formed at the muzzle across the launcher projectile rails where the projectile exits the launcher.

2. Description of the Prior Art

Electromagnetic projectile launchers, generally, include a pair of electrically conductive rails which guide a projectile. The projectile is launched by quickly injecting, or commutating, an electrical current through one of the rails which then passes through the armature of the projectile and returns to the current source through the other rail. Acceleration of the projectile is substantially produced by the interaction of the current through the armature of the projectile and the magnetic field which is produced by the same current flowing in the conductive rails.

Electrical current flows through both the armature of the projectile and the launcher rails as the projectile accelerates along the rails. Initially two electrical arcs form between the armature of the projectile and each of the rail ends at the moment the projectile exits the rails at the launcher muzzle due to the interruption of metallic current conduction where the armature slides on the rail surfaces. As the armature moves father from the muzzle, current flow through the armature ceases with arcing instead continuing directly across the muzzle projectile rail ends.

Such electrical arcing is undesirable for three reasons. First, energy dissipated in an electrical arc is converted into heat and provides no useful energy in accelerating the projectile.

Second, the visible light produced by the electrical arc may be seen by an opponent against whom the projectile is being launched. Third, the electrical arc generates electromagnetic radiation which may be detected by an opponent against whom a projectile is launched.

The present invention is useful in eliminating or significantly reducing such undesireable arcing.

SUMMARY OF THE INVENTION

Apparatus is provided for minimizing the electrical arcing at the muzzle of an electromagnetic projectile launcher which includes current injecting apparatus cooperating with the launcher for generating a generally unidirectional current in a first direction through the armature of the projectile when the projectile is in the first section and second section of the launcher. Electrical circuit apparatus cooperating with the launcher and the current injecting apparatus is provided for supplying a generally unidirectional current in the direction opposite the first direction through the armature of the projectile when the projectile is in the second section of the launcher, whereby the net current flowing through the armature of the projectile is substantially reduced when the projectile exits the muzzle.

Also provided is a method for minimizing electrical arcing at the muzzle of an electromagnetic projectile launcher which includes the steps of providing apparatus, generally, of the type described above. The projectile is then moved through the launcher, and a generally unidirectional current is provided in the first direction through the armature when the projectile is in the first section and the second section of the launcher. A generally unidirectional current in a direction opposite the first direction is provided through the armature of the projectile when the projectile is in the second section of the launcher, whereby the net current flowing in the armature of the projectile is substantially reduced when the projectile exits the muzzle.

BRIEF DESCRIPTION OF THE DRAWINGS

The invention may be better understood and further advantages and uses thereof are readily apparent, when considered in view of the following detailed description of the preferred embodiment taken with the accompanying drawings in which.

DETAILED DESCRIPTION OF THE PREFERRED EMBODIMENT

Figure 1:
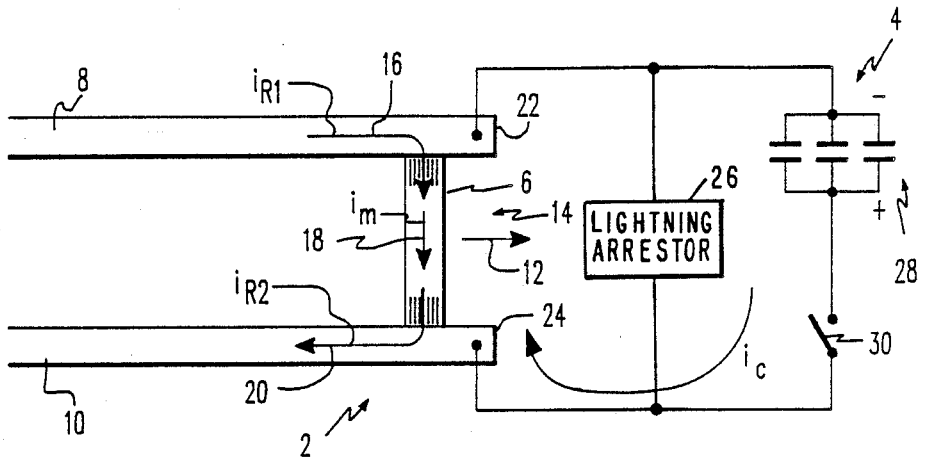
FIG. 1 is a schematic diagram of a projectile launcher which attempts to reduce muzzle arcing through the employment of capacitors and a lightning arrestor.

FIG. 1 shows projectile launcher 2 which includes muzzle arc suppressor circuitry 4; a conventional counter-pulsing circuit. Projectile launcher 2 is designed to launch a projectile (not shown) which is mechanically attached to electrically conducting armature 6 along rails 8 and 10 in the direction of arrow 12 so that armature 6 exits projectile launcher 2 at muzzle 14.

As is well known in the art, armature 6 is accelerated in the direction of arrow 12 by injecting current in rail 8 and into armature 6 in the direction of arrow 16, through armature 6 in the direction of arrow 18, and from armature 6 and into rail 10 in the direction of arrow 20. The current is generated by a launch power generator (not shown) which is well known to those of ordinary skill in the art. The interaction between the current which flows through armature 6, in the direction of arrow 18, and the magnetic field which develops as the result of current flowing through rails 8 and 10, causes armature 6 to be accelerated.

Projectile launcher 2 has an inherent inductance, L, since a magnetic field is formed when current flows through rails 8 and 10. Rails 8 and 10 store an inductive energy equal to $\frac{1}{2}$ $Li^2$. Current flow $i_{R1}$ and $i_{R2}$, in rails 8 and 10, can cease after armature 6 exits muzzle 14, only after the inductive energy is either depleted or transferred. The energy would primarily dissipate in the form of an electrical arc across rail ends 22 and 24 if circuitry 4 were not provided to transfer the energy.

Three distinct current conduction paths will be affected at the instant that armature 6 exits muzzle 14. The first will be $i_{R1}$ which is flowing in the direction of arrow 16 through rail 8 into armature 6. An arc will form between rail end 22 and armature 6 as contact between those two members is lost. The second is $i_m$ which is the current flow in the direction of arrow 18 through armature 6. The third is $i_{R2}$ which is flowing in the direction of arrow 20 from armature 6 into rail 10. An arc will form between rail end 24 and armature 6 as contact is lost between those two members.

The following will occur without circuitry 4. Initially, two short arcs will form between armature 6 and rail ends 22 and 24 as metallic conduction contact between armature 6 and rail ends 22 and 24 is lost. The two arcs will lengthen and coalesce, or short, into direct arcing between rail ends 22 and 24, as armature 6 recedes from muzzle 14, which, in turn, results in rapid cessation of $i_m$. Arcing will continue until the inductive energy is dissipated.

The following will occur by employing circuitry 4. Capacitor bank 28 is charged by an external source (not shown). Switch 30 is provided to discharge capacitor bank 28, thereby providing a current $i_c$, at the moment that armature 6 exits muzzle 14. Current $i_c$ flows in the opposite direction of $i_m$ and is of a magnitude, generally, equal to current $i_m$. Therefore, current $i_c$ produces a current zero through armature 6 at the moment armature 6 exits muzzle 14.

No change in current occurs as armature 6 exits muzzle 14 since the current flowing through armature 6 is equal to approximately zero immediately before and immediately after armature 6 exits muzzle 14. Therefore, the likelihood of arcing between rail ends 22 and 24 and armature 6 is reduced. However, the inductive energy caused by the flow of $i_{R1}$ and $i_{R2}$ in rails 8 and 10 still exists and must be transferred or dissipated. If no path is provided to transfer the inductive energy then a large voltage will be generated at rail ends 22 and 24 which will tend to cause insulation breakdown, and undesirable electrical arcing.

Capacitor bank 28 can provide a current path to accommodate the continued flow of $i_{R1}$ and $i_{R2}$. However, capacitor bank 28 does not, from a practical standpoint, have a sufficient storage capacity to accommodate all of the energy without charging to a voltage level which may be enough to cause electrical arcing across rail ends 22 and 24. That is because a storage capacity of only about 100 kilojoules is necessary for generating the proper magnitude of $i_c$ while the inductive energy may be as high as 1000 kilojoules. Lightning arrestor 26, therefore, is provided to further facilitate the dissipation of the inductive energy. Lightning arrestor 26 is sized to break down and become conducting when the voltage across capacitor bank 28 and, thus, rail ends 22 and 24 is less than the voltage necessary to generate an electrical arc therebetween. Therefore, before an electrical arc forms across rail ends 22 and 24, lightning arrestor 26 dissipates the energy thereby preventing the formation of electrical arcing.

Never-the-less, muzzle arc suppressor circuitry 4 still requires both a massive capacitor bank 28, capable of storing at least in the order of 100 kilojoules of energy, and lightning arrestor 26 at a location close enough to muzzle 14 to present a low inductance loop at rail ends 22 and 24, for effective functioning. Such arrangement of circuit elements, while technically not impossible, is impractical. The present invention overcomes such limitations.

Figure 2:
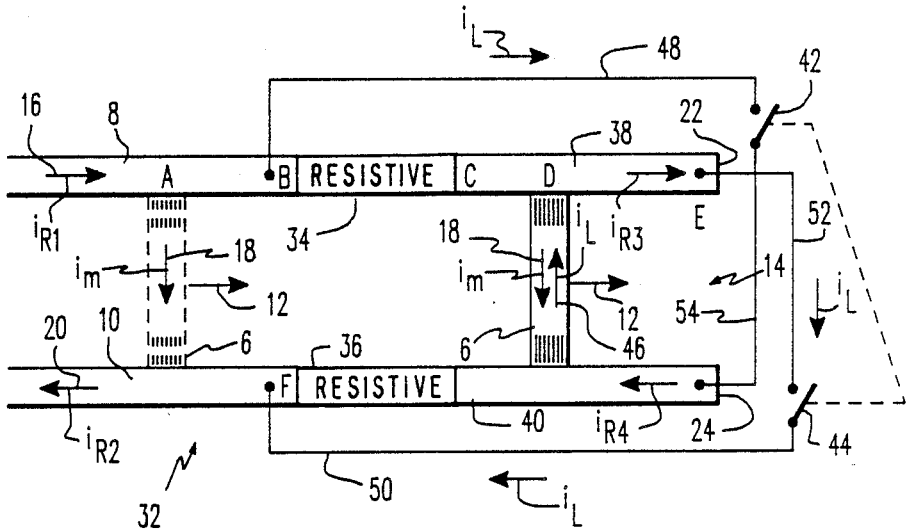
FIG. 2 is a schematic diagram of a projectile launcher which employs the present invention.

FIG. 2 shows projectile launcher 32 which employs the apparatus of the present invention. The apparatus of FIG. 2 is unique in that it is able to generate a current zero in armature 6 without capacitive storage of energy or resistances external to rails 8 and 10. Projectile launcher 32 includes low resistance rails 8 and 10 which supply power to and guide armature 6 in the direction of arrow 12. In series with rails 8 and 10 are more resistive rail portions 34 and 36, respectively, which are followed, in series, by low resistive rail portions 38 and 40. Rail portions 34, 36, 38 and 40 also supply power to and guide armature 6 in the direction of arrow 12.

Projectile launcher 32 functions much in the same manner as projectile launcher 2, of FIG. 1, until armature 6 reaches position B. That is because, before armature 6 reaches position 8, for example when it is located at position A, virtually all of current $i_{R1}$ travels through armature 6 to rail 10, bypassing more resistive portions 34 and 36 and rail portions 38 and 40. Therefore, $i_{R1}$ equals $i_m$ which, in turn, equals $i_{R2}$.

Armature 6 travels along more resistive rail portions 34 and 36 upon passing position B, and until reaching position C. Switches 42 and 44 are closed when armature 6 reaches position D. An increasing ohmic rail voltage drop is generated in resistive portions 34 and 36 as armature 6 travels from B to C. This rail voltage drop, along with the back electromagnetic voltage which is inherent in launcher 32, initiates the flow of current $i_L$ in the direction of arrow 46, after switches 42 and 44 are closed. Current $i_L$ is, thus, injected into armature 6, in the direction of arrow 46, to counteract $i_m$ and produce a current zero in armature 6 to reduce or eliminate arcing when armature 6 exits muzzle 14. Preferably, $i_L$ will be exactly equal to $i_m$ at the moment when armature 6 exits muzzle 14.

Current $i_L$ flows through conductor 48, which is connected to rail 8 at position B, through switch 42 and conductor 54, through armature 6 in the direction of arrow 46, through conductor 52, switch 44, conductor 50 and rail 10 with switches 42 and 44 closed. Conductor 50 is connected to rail 10 at position F. Current $i_L$, therefore, bypasses more resistive portions 34 and 36 in favor of traveling through the lower resistance of conductors 48, 50, 52 and 54 and switches 42 and 44. Conductors 48, 50, 52 and 54 and switches 42 and 44, along with their respective connections to projectile launcher 32, form the apparatus of the present invention.

From the moment switches 42 and 44 are closed, when armature 6 is at position D, current $i_L$ begins to increase in magnitude until armature 6 reaches position E which is at muzzle 14. Current $i_L$ is then of a magnitude, generally, equal in value to $i_m$ at the moment armature 6 exits muzzle 14. At that instant the net current in armature 6 equals zero. Since no current is flowing through armature 6 both immediately before and immediately after armature 6 exits muzzle 14, no change in current through armature 6 occurs as armature 6 exits muzzle 14 and no arcing need occur.

Currents $i_{R3}$ and $i_{R4}$ are cut off from flowing through armature 6 at the moment that armature 6 exits muzzle 14. Current $i_{R3}$, however, then flows through conductor 52, switch 44, conductor 50 and rail 10. Current $i_{R3}$, thus, becomes $i_L$ and, since $i_m$ equals $i_L$ and $i_m$ equals $i_{R4}$, $i_{R4}$ equals $i_L$.

Current $i_{R4}$, therefore, continues to flow by now drawing current $i_L$ from rail 8, conductor 48, switch 42 and conductor 54. Therefore, currents $i_{R3}$ and $i_{R4}$ continue to flow virtually uninterrupted and unchanged at the moment armature 6 exits muzzle 14. No arc, therefore, will discharge between rail ends 22 and 24 and armature 6 since no change in currents $i_{R3}$, $i_{R4}$ or $i_L$ occurs and no currents are injected into conductors which were previously carrying different current magnitudes.

The circuitry of FIG. 2, therefore, splits current $i_{R1}$ into two halves, after switches 42 and 44 are closed, with one-half of the current flowing through armature 6 as $i_m$ and the other half flowing through armature 6 as $i_L$. The calculation of the linear distance that position D is separated from position E can be readily determined by calculations involving basic mechanics and electrical circuitry, which are well known to those of ordinary skill in the art.

It should be understood that while a metallic armature has been illustrated, which provides the required current conduction across the rails and which accelerates a projectile attached to it, a plasma or arc armature between the rails may similarly provide the conducting current path between the rails of the projectile launcher. As is well known, a plasma or arc armature is a volume of conducting gas formed across rails 8 and 10 when no metallic current path is provided. In this case, the plasma or arc armature may be employed to apply the accelerating force in the form of gas pressure against a bore-sealing and electrically insulating sabot which fixtures and accelerates the projectile.

It is possible to operate launcher 32 with switches 42 and 44 continually closed. Under this mode of operation, there will be only negligible parasitic currents in the muzzle circuits before armature 6 enters into resistive portions 34 and 36. This mode of operation requires consistency in armature exit velocity and acceleration current for satisfactory muzzle arc suppression. This mode of operation is achieved without switches by calculating the proper length and resistiveness of rail portions 34 and 36 and the proper length of rail portions 38 and 40 so that the required current zero through armature 6 occurs as armature 6 exits muzzle 14. Such calculations, also, involve basic mechanics and electrical circuitry which are well known to those of ordinary skill in the art.

If a complete current zero does not occur as armature 6 exits muzzle 14, a substantial reduction in arcing, never-the-less would occur. Arc damage is likely to be proportional to approximately the square of the armature current Therefore, muzzle arc damage with one twentieth of full muzzle current still flowing would likely cause less than one four hundredth the damage if full armature current were still flowing.

It will be obvious to those of ordinary skill in the art that resistive portions 34 and 36 may be eliminated without compromising the operation of the invention. The disadvantage of eliminating resistive portions 34 and 36 is that the net armature current, as the projectile advances from position B to position E, decreases more slowly to zero thereby requiring additional rail length for proper projectile exit velocity and elimination of arcing. Therefore, the best mode for implementing the present invention is to include resistive portions 34 and 36 in series with rails 8 and 10.

It may be appreciated, therefore, that the apparatus and method of the present invention is useful in eliminating or substantially reducing muzzle arcing when a projectile exits an electromagnetic projectile launcher without the need for external massive components such as capacitors and lightning arrestors.

Whereas particular embodiments of the invention have been described above for purposes of illustration, it will be evident to those skilled in the art that numerous variations of the details may be made without departing from the invention as defined in the appended claims.

What is claimed is:

1. Apparatus for minimizing electrical arcing at the muzzle of an electromagnetic projectile launcher which includes a first section, a second section and a muzzle comprising:

current injecting means cooperating with the launcher for generating a generally unidirectional current in a first direction through the armature of the projectile when the projectile is in the first section and second section of the launcher; and electrical circuit means cooperating with the launcher and said current injecting means for supplying a generally unidirectional current in a direction opposite said first direction through the armature of the projectile when the projectile is in the second section of the launcher;

said current injecting means being rail means, said rail means including a first rail with a first segment and a second segment and a second rail with a third segment and a fourth segment;

said first segment being electrically connected to said fourth segment;

said second segment being electrically connected to said third segment; and said rail means including first and second portions with said first portion being of a higher resistance than said second portion, whereby the net current flowing through the armature of the projectile is substantially reduced when the projectile exits the muzzle.

* * * * *